US007850579B2

(12) United States Patent
Whitall et al.

(10) Patent No.: US 7,850,579 B2
(45) Date of Patent: Dec. 14, 2010

(54) BILATERAL ARM TRAINER AND METHOD OF USE

(75) Inventors: Jill Whitall, Annapolis, MD (US); Sandy McCombe-Waller, Ellicott City, MD (US); David Grant, Towson, MD (US)

(73) Assignee: University of Maryland, Baltimore, Baltimore, MD (US)

( * ) Notice: Subject to any disclaimer, the term of this patent is extended or adjusted under 35 U.S.C. 154(b) by 784 days.

(21) Appl. No.: 11/353,033

(22) Filed: Feb. 14, 2006

(65) Prior Publication Data

US 2006/0194677 A1 Aug. 31, 2006

Related U.S. Application Data

(63) Continuation of application No. 10/182,870, filed as application No. PCT/US01/01222 on Feb. 1, 2001, now Pat. No. 7,121,981.

(60) Provisional application No. 60/179,511, filed on Feb. 1, 2000.

(51) Int. Cl.
*A63B 21/00* (2006.01)

(52) U.S. Cl. ..... 482/92; 482/101; 482/132

(58) Field of Classification Search ..... 482/44, 482/71, 79, 114, 101, 131, 132, 141, 70; 434/255, 261, 258

See application file for complete search history.

(56) References Cited

U.S. PATENT DOCUMENTS 4,099,713 A * 7/1978 Spector ..... 482/3
4,111,417 A * 9/1978 Gardner ..... 482/128
4,629,185 A 12/1986 Amann
4,773,398 A 9/1988 Tatom
4,781,372 A 11/1988 McCormack
5,031,898 A 7/1991 Anthony
5,254,066 A 10/1993 Brown et al.
5,911,650 A * 6/1999 Cox ..... 482/70
6,514,180 B1 2/2003 Rawls

OTHER PUBLICATIONS

Luft, et al., "Repetitive Bilateral Arm Training and Motor Cortex Activation in Chronic Stroke, A Radonmized Controlled Trial", JAMA, vol. 292, No. 15, pp. 1853-1861, 2004.

(Continued)

*Primary Examiner*—Glenn Richman
(74) *Attorney, Agent, or Firm*—DLA Piper LLP (US)

(57) ABSTRACT

A device and method for bilateral upper extremity training for patients with a paretic upper extremity, the device facilitating cortical remodeling, sustained relearning, and improvement in functional outcomes in paretic and possibly non-paretic upper extremities. In one variation, the device includes a base, an adjustable chest plate for placing the user at a set distance from the device and isolating arm movement, an incline plate attached and inclinable relative to the base, two width plates adjustably attached to the incline plate, and two swivel plates adjustably attached to the width plates. In one variation, the swivel plates are swivalable relative to a fixed point in a plane parallel to the plane of the width plates. In another variation, the swivel plates are pivotably attached to the width plates. Other features of the device include a counter for counting user activity, and audible and visual cueing devices for facilitating sustained learning.

21 Claims, 9 Drawing Sheets

OTHER PUBLICATIONS

C. Gowland, et al., "Agonist and Antagonist Activity During Voluntary Upper-limb Movement in Patients with Stroke", Physical Therapy, vol. 72, No. 9, pp. 624-633, 1992.

H. Nakayama, et al., "Compensation in Recovery of Upper Extremity Function After Stroke: The Copenhagen Stoke Study", Arch Phys Med Rehabil, vol. 75, pp. 852-857, 1994.

R. J. Nudo, et al., "Reorganization of Movement Representations in Primary Motor Cortex Following Focal Ischemic Infarcts in Adult Squirrel Monkeys", Journal of Neruophysiology, vol. 75, No. 5, pp. 2144-2149, 1996.

R. J. Nudo, et al., "Use-Dependent Alterations of Movement Representations in Primary Motor Cortes of Adult Squirrel Monkey's", The Journal of Neuroscience, vol. 16, No. 2, pp. 785-807, 1996.

R. J. Nudo. et al., "Neural Substrates for the Effects of Rehabilitative Training on Motor Recovery After Ischemic Infarct", Science, vol. 272, pp. 1791-1794, 1996.

C. Ostendorf, et al., "Effect of forced Use of the Upper Extremity of a Hemiplegic Patient on Changes in Function", Physical Therapy, vol. 61, No. 7, pp. 1022-1028, 1981.

E. Taub, et al., "Technique to Improve Chronic Motor Deficit Stroke", Arch Phys Med Rehabil, vol. 74, pp. 347-354, 1993.

J. Desrosiers, et al., Performance of the 'Unaffected' Upper Extremity of Elderly Stroke Patients' Stroke, vol. 27, No. 9, pp. 1564-1570, 1996.

G.P. Prigatano, et al., "Speed of Finger Tapping and Goal Attainment After Unilateral Cerebral Vascular Accident", Arch Phys Med Rehabil, vol. 78, pp. 847-852, 1997.

S.L. Wolf, et al., "Forced Use of Hemiplegic Upper Extremities to Reverse the Effect of Learned Nonuse amoung Chronic Stroke and Head-Injured Patients", Experimental Neurology, vol. 104, pp. 125-132, 1989.

* cited by examiner

BILATERAL ARM TRAINER AND METHOD OF USE

This application is a continuation of U.S. patent application Ser. No. 10/182,870 filed Nov. 18, 2002 now U.S. Pat. No. 7,121,981, which is a national stage application pursuant to 35 U.S.C. §371 of International Application No. PCT/US 01/01222 with an International filing date of Feb. 1, 2001, which claims priority to U.S. Provisional Application Ser. No. 60/179,511 filed Feb. 1, 2000. The entirety of those applications are incorporated herein by reference.

The development of the present invention was supported by the University of Maryland, Baltimore and the University of Maryland Medical System.

BACKGROUND OF THE INVENTION

1. Field of the Invention

This invention relates to a device for bilateral upper extremity training for patients with a paretic upper extremity, and more specifically, to a device providing bilateral upper extremity training that facilitates cortical remodeling, sustained relearning and improvement in functional outcomes in both the paretic and non-paretic upper extremity, as well as, to a method of using the device to accomplish sustained relearning of motor tasks and improved bimanual motor coordination in individuals with a paretic upper extremity.

2. Background of the Technology

Hemiparesis involving the upper extremity following stroke profoundly impacts the functional performance of stroke survivors. There are an estimated 750,000 strokes each year in the United States alone. Of these, more than 300,000 individuals survive stroke; however, these individuals often survive with resultant significant disability. Only 5% of adults regain full arm function following stroke and 20% regain no functional use at all (see, e.g., Gowland, C., et al., and Antagonist Activity During Voluntary Upper- *limb Movement in Patients with Stroke,* 72 Physical Therapy 624-633 (1992)). It has been previously reported that little change can be facilitated in upper extremity function after approximately 11 weeks following stroke (Nakayama, H., et al., *Recovery of Upper Extremity Function in Stroke Patients: The Copenhagen Study,* 75 Archives of Physical Medicine and Rehabilitation 852-857 (1994)). Recent evidence, however, suggests that improvement in functional performance of the upper extremity can be seen in patients beyond 11 weeks post-stroke. Animal studies indicate that both central neural remodeling and functional gains can occur long after injury. For example, monkey models of chronic stroke demonstrated functional recovery, as well as, cortical reorganization after being forced to use their paretic limb (see Nudo, R. J., et al., *Reorganization of Movement Representations in Primary Motor Cortex Following Focal Ischemic Infarcts in Adult Squirrel Monkeys,* 75 J. Neurophys. 2144-49 (1996); Nudo, R. J., et al., *Use-Dependent Alterations of Movement Representations in Primary Motor Cortex of Adult Squirrel Monkeys,* 16 J. Neurosc. 785-807 (1996); Nudo, R. J., et al., *Neural Substrates for the Effects of Rehabilitative Training on Motor Recovery After Ischemic Infarct,* 272 Science 1791-4 (1996)). The expansion of cortical maps corresponds to both the affected and non-affected limbs.

While improvement in functional performance of hemiparetic patients is possible, usage of training devices may increase the improvement. However, most training devices are for aerobic exercise or strength training; they do not allow for flexible training of natural actions used in many activities of daily living. The majority of the devices of the prior art are yoked (connected handles) and driven by muscle building principles rather than motor control/neuroplasticity principles. Such an arrangement allows the stronger upper extremity to "carry" the weaker upper extremity, limiting the stress on and active involvement of the weak arm. Alternatively, other devices of the prior art are designed for unilateral strengthening of the paretic arm while the non-paretic limb is constrained. There is increasing evidence that the "unaffected" limb following unilateral stroke presents with some dysfunction relating to the loss of neurophysiological linkage in the central nervous system. Thus, the devices of the prior art fail to rehabilitate the unaffected limb in concert with the paretic limb, which is essential for many tasks. Bilateral upper extremity training of the present invention has the capability to be an effective training paradigm to promote agonist muscle activity in the paretic limb and to promote a facilitation effect from the non-paretic to the paretic limb. Furthermore, the device and method of the present invention has the capability to result in bilateral relearning and cortical remodeling, which improves both intralimb and interlimb coordination and functional outcome.

The specific effects on motor function and coordination post-stroke in the upper extremity have been previously evaluated in fairly high functioning patients. During reaching and grasping tasks, post stroke subjects presented with segmented movement patterns demonstrated difficulty with interjoint coordination especially involving the shoulder and the elbow. When movement times are increased during these tasks, adaptive patterns of movement can be seen. Although there are conflicting reports in the literature as to the specific causes of these differences, it appears that decreased agonist recruitment and poor sensorimotor control seem to be key factors that limit the ability of subjects to carry out these tasks in a smooth and coordinated fashion. This principle extends to bilateral task specific coordination, as well.

While previous reports suggested that little change can be facilitated in upper extremity (UE) function after approximately 11 weeks following stroke, other reports suggests that improvement in functional performance of the upper extremity can be seen in patients with chronic stroke. For example, it has been demonstrated that improved functional performance can occur in UE functions of chronic stroke patients with forced use of the affected limb and restraint of the unaffected limb (see Ostendorf, C., et al, *Effect of Forced Use of the Upper Extremity of a Hemiplegic Patient on the Changes in Function,* 61 Phys. Ther. 1022-1028 (1981); Wolf, S., et al., *Forced Use of Hemiplegic Extremities to Reverse the Effect of Learned Nonuse among Chronic Stroke and Head Injured Patients,* 104 Exp Neuro. 125-132 (1989)). These studies offer promise for the rehabilitation of a stroke survivor, but they involve training of a single limb and are restricted to fairly high functioning patients.

For example, in Taub, E., et al., *Technique to Improve Chronic Motor Deficit After Stroke,* 74 Archives of Physical Medicine and Rehabilitation 347-354 (1983), patients were excluded if they could not achieve at least 10 degrees of extension at the metacarpophalangeal and interphalangeal joints of the hand and 20 degrees of extension at the wrist of the affected limb. Wolf et al. (1989) required subjects to be able to actively initiate wrist and finger extension on the paretic side. This has restricted the success of the forced use paradigm to the higher functioning patient. Using the present invention, however, a patient with minimal active movement, limited to just the shoulder, demonstrated changes in upper extremity function. Thus, the present invention is capable of being used by patients at all levels of recovery post stroke, providing minimal movement is present.

In addition, many human physical functions involving the upper extremities are bilateral in nature, and, although each limb may not perform the same specific task, there exists a coordination between upper limbs that permits functional efficiency. Therefore, the present invention, a bilateral upper extremity exercise training device, facilitates greater improvement of the paretic upper extremity than a unilateral one.

Finally, as mentioned earlier, evidence shows that the "unaffected" limb following unilateral stroke presents with dysfunction as well. Limitations have been demonstrated in fine and gross motor dexterity, motor coordination, global functional performance, thumb kinesthesia, speed of finger taping and grip strength (Desrosiers, J., et al., *Performance of the 'Unaffected' Upper Extremity of Elderly Stroke Patients,* 27 Stroke 1564-70 (1996); Prigatano, G., et al., *Speed of Finger Tapping and Goal Attainment After Unilateral Cerebral Vascular Accident,* 78 Archives of Physical Medicine and Rehabilitation 847-852 (1997)). This suggests a potential benefit to both upper extremities with bilateral versus strict unilateral training of the upper extremities post-stroke.

No studies have been done evaluating the effectiveness of an exercise intervention for post-stroke hemiplegia where training involves both upper extremities at the same time. Training in this context may help the neuromuscular system to use the extremities in a more coordinated fashion that will not only improve motor performance of the hemiplegic upper extremity but may impact functional outcomes of both limbs as well. For example, Gauthier, et al. (1994) demonstrated improvement in the muscle activity and torque production of the hemiplegic lower extremity through training that included resistive exercise of the "unaffected" lower extremity. This provides evidence that the use of bilateral training can be an effective training mechanism for the motor performance of the lower extremity. Other studies have also demonstrated functional gains in bilateral training of the lower extremities using a treadmill or walking protocols.

Most currently used rehabilitation therapies require the presence of a therapist; patients can not use such therapies on their own. Alternatively, robotic therapy devices are complex, bulky and expensive. None of the physical therapy or exercise devices currently available disclose a simple, portable, non-motorized, adjustable and independent bilateral limb trainer.

SUMMARY OF THE INVENTION

It is an advantage of the present invention to provide a novel unyoked bilateral upper extremity exercise device to promote agonist muscle activity in the paretic limb and the relearning of sensorimotor relationships during task specific limb function.

It is another advantage of the present invention to mimic natural human physical functions involving unilateral and bilateral simultaneous or alternating activities of the upper extremities in a variety of positions.

It is a further advantage of the present invention to provide a portable, versatile and inexpensive bilateral upper extremity exercise device for post-stroke hemiparesis to use without requiring the presence of a therapist. It is yet a further advantage to construct the device from lightweight materials, such as lucite, wood, metal, and/or carbon composites, or other lightweight materials, so that the device is easily portable.

It is a further advantage of the present invention that the device have straight tracks or curved tracks, permitting the upper limbs to move in a variety of positions and directions. The use of different patterns of movement in the training program may invoke the motor learning principle of contextual interference. Changing one=s movement is known to increase the learning and retention of those movements. With the device and method of the present invention, users reconstruct muscle synergy patterns with a concomitant change of attentional focus and enhanced learning.

It is a further advantage of the present invention that the device have various angles in the transverse through frontal planes. It is yet another advantage of the present invention that the device permits movement in various directions in various planes relative to the person using the device.

It is another advantage of the present invention that people suffering from diminished control of their shoulder(s), arm(s), elbow(s), forearm(s), hand(s), wrist(s), or finger(s) are able to use this device to improve the function and control over their shoulder(s), arm(s), elbow(s), forearm(s), hand(s), wrist(s), and finger(s).

It is a further advantage of the present invention that the device is adjustable to accommodate users of various stature, as well as, for a range of motion for each user.

It is another advantage of the present invention to improve the control, flexibility, and/or range of motion of the shoulder(s), arm(s), elbow(s), forearm(s), hand(s), wrist(s), and finger(s) of the user.

It is another advantage of the present invention to have a counter or a tracker of usage so that one is able to confirm usage of the device in a setting other than under the supervision of a physical therapist, physician, nurse, trainer, medical personal, or other type of supervisor.

It is another advantage of the present invention to provide an auditory or visual stimulus for feedback. The beat of a metronome and/or the mirrored reflection of the participant's movements provide a form of intrinsic feedback to the participant, who is able to judge thereby how accurate they are in performing the task, as well as, focusing attention on the timing of the beat, the reflected movement, and the end-points of the reaching movements. Both are important for motor learning. It is a further advantage of the present invention to provide an auditory or visual stimulus for goal setting, which is another major fundamental principle of motor learning.

It is an advantage of an embodiment of the present invention that the device provides little or no resistance with regard to movement of handles within the tracks. It is yet another advantage that the little or no resistance of the handles within the tracks occurs by use of rollers, wheels, or other features for minimizing resistance to movement.

It is an advantage of the device of another embodiment of the present invention that weights and resistance may be added for facilitating relearning of bimanual movements that mimic the behavior of reaching and bringing objects toward the user. It is a further advantage of the present invention that strength training of one or both upper extremities can be accomplished with the device.

It is further an advantage that the handles can be yoked or unyoked. The advantages of an unyoked device have been described above. Under some circumstances yoking the handles of the device of the present invention may additionally facilitate sensorimotor relearning necessary for controlled and coordinated bimanual activities.

It is yet another advantage of the present invention that sensorimotor relearning is enhanced using shorter and more frequent training periods and less dependence on conditioning effects than devices and methods of the prior art.

An embodiment of the present invention comprises a portable arm control training device that has two unyoked handles that are capable of traveling along straight or curved tracks at various angles in transverse through frontal planes. In one embodiment, the handles move along the tracks without or with little resistance, such little resistance being accomplished through the use of rollers, wheels, or other devices for minimizing friction or other resistance. In another embodiment, weights or resistance are addable to the handle movement along the tracks, to facilitate relearning or to add strength training.

The present invention is specifically designed for use with the post-stroke population, but also potentially has more general use with other populations (e.g., patients suffering from head injuries, brain tumors, cerebral palsy). The present invention's various modular features make it useable by individuals of different stature and body habitus, and with different capabilities, depending on the severity of the paresis. The present invention=s various modular features permit people with a range of limb control control to use the device.

The present invention's modular design, as well as its construction from lightweight materials, such as lucite, wood, metals, carbon composites, and/or other lightweight materials, makes it portable, flexible, easy to use, versatile and inexpensive. Thus, the present invention may be used by individuals with a paretic upper extremity without the presence of a therapist.

The present invention offers a novel exercise intervention for post-stroke hemiparesis resulting from, for example, stroke, head injuries, brain tumors, or cerebral palsy, where training involves both upper extremities at the same time. Thus, training with the present invention helps the neuromuscular system to relearn control the extremities in a more coordinated fashion that not only improves motor performance of the paretic upper extremity but impacts functional outcome of both upper extremities.

To achieve the stated and other advantages of the present invention, as embodied and described below, the invention further includes a device for bilateral upper extremity training, comprising: a base; a pair of sliding tracks attached to the base; and a pair of handles slidably movable along the sliding tracks, wherein the handles are unyoked and have minimal resistance for movement along the tracks.

To achieve the stated and other advantages of the present invention, as embodied and described below, the invention further includes a device for bilateral arm training for a user, comprising: a pair of connected swivel plates, each of the swivel plates being independently swivelable about a point on the swivel plate, such that each of the swivel plates may be swiveled to a selected angle, wherein the connected pair of swivel plates has a first end and a second end; a pair of sliding tracks attached to the pair of swivel plates; a pair of handles slidably movable along the sliding tracks; an incline device connected to the first end of the pair of swivel plates, such that the pair of swivel plates may be inclined relative to the second end of the pair of swivel plates; and a user distancing device connected to the second end of the pair of swivel plates, the user distancing device for maintaining the user at a set distance while the user grasps the pair of handles; wherein the pair of sliding tracks may be adjusted by inclination of the pair of swivel plates and by swiveling of the pair of swivel plates, such that a variable range of motions may be made by the user via the pair of handles.

To achieve the stated and other advantages of the present invention, as embodied and described below, the invention further includes a bilateral arm trainer for a user, comprising: a base securable to a fixed surface; an incline plate pivotably attached to the base; a first width plate and a second width plate, the first width plate and the second width plate being adjustably attached to the incline plate; a first swivel plate and a second swivel plate, the first swivel plate being attached to the first width plate and the second swivel plate being attached to the second width plate, wherein the first swivel plate is swivelable about a first swivel plate point relative to the first width plate, and wherein the second swivel plate is swivelable about a second swivel plate point relative to the second width plate; a first track attached to the first swivel plate and a second track attached to the second swivel plate; a first handle movable along the first track and a second handle movable along the second track; an incline device for pivotably inclining the incline plate relative to the base; and an adjustable chest rest attached to the base for maintaining the user at a set distance while the user grasps the pair of handles; wherein the first track and the second track are adjustable by inclination of the incline plate and swiveling of the first swivel plate and the second swivel plate, such that a variable range of motions may be made by the user via the pair of handles.

To achieve the stated and other advantages of the present invention, as embodied and described below, the invention further includes a bilateral arm trainer for a user, comprising: a base securable to a fixed surface; an incline plate pivotably attached to the base; a first width plate and a second width plate, the first width plate and the second width plate being adjustably attached to the incline plate; a first swivel plate and a second swivel plate, the first swivel plate being attached to the first width plate by a first swivel plate pivoting device and the second swivel plate being attached to the second width plate by a second swivel plate pivoting device, wherein the first swivel plate is pivotable relative to the first width plate, and wherein the second swivel plate is pivotable relative to the second width plate; a first track attached to the first swivel plate and a second track attached to the second swivel plate; a first handle movable along the first track and a second handle movable along the second track; an incline device for pivotably inclining the incline plate relative to the base; and an adjustable chest rest attached to the base for maintaining the user at a set distance while the user grasps the pair of handles; wherein the first track and the second track are adjustable by inclination of the incline plate and pivoting of the first swivel plate and the second swivel plate, such that a variable range of motions may be made by the user via the pair of handles.

To achieve the stated and other advantages of the present invention, as embodied and described below, the invention further includes a method for cortical remodeling and sensorimotor relearning for a person suffering from neurological damage caused by one from a group consisting of stroke, tumor, and injury, the neurological damage resulting in diminished movement of at least one upper body extremity, the method comprising: moving a pair of unyoked handles along a pair of sliding tracks, wherein the sliding tracks are attached to a base, wherein the handles move with a minimum of resistance along the sliding tracks for a period of time, and wherein the moving of the pair of unyoked handles unmasks neural pathways.

Additional advantages and novel features of the invention will be set forth in part in the description that follows, and in part will become more apparent to those skilled in the art upon examination of the following or upon learning by practice of the invention. While the name of the device suggests bilateral arm training it should be clear that the device is intended for rehabilitation of all joints and muscles of the upper limbs. Use of the term arm is intended to include the entire upper extremity.

DETAILED DESCRIPTION

Figure 1:
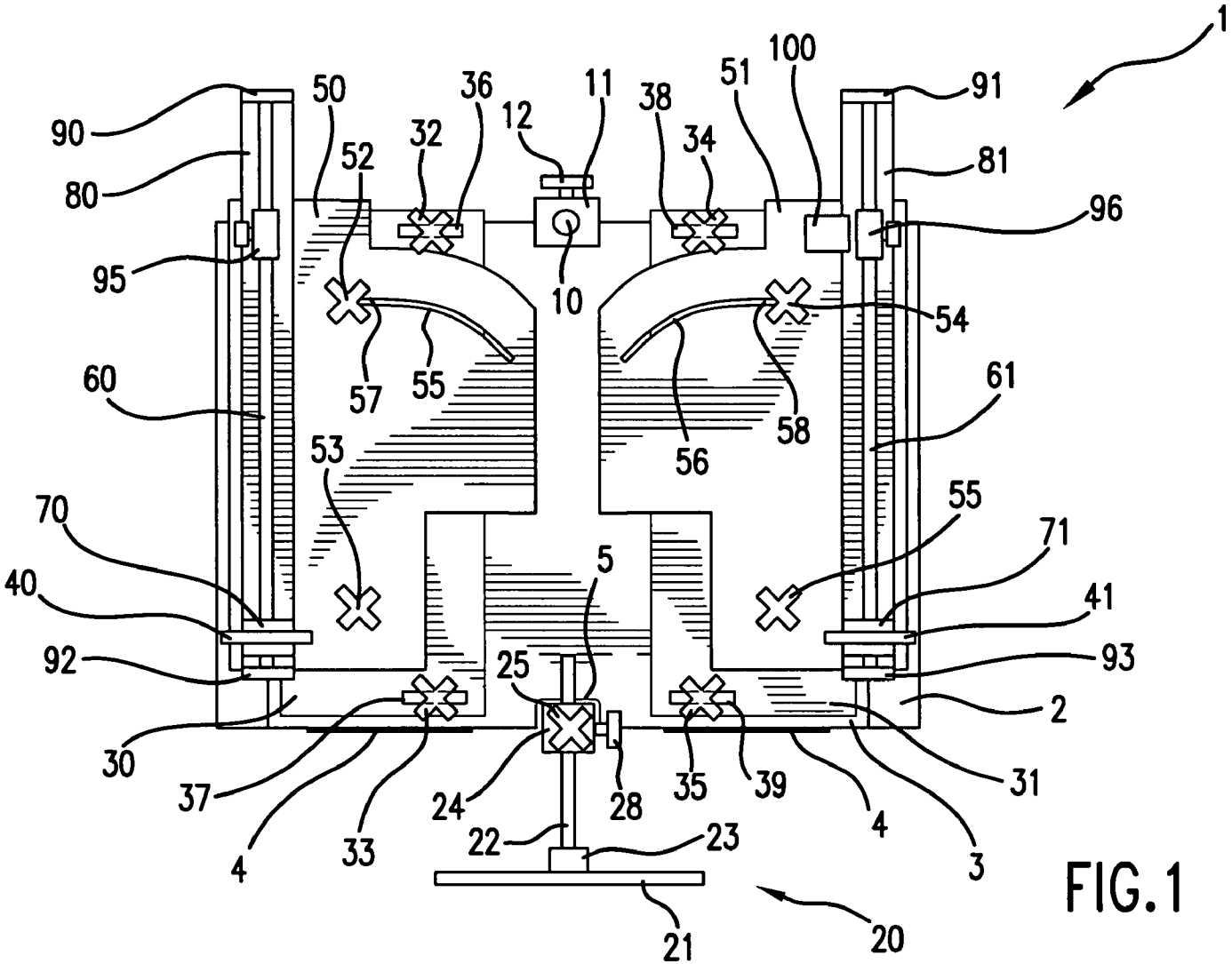
FIG. 1 presents an overhead view of a bilateral arm trainer in accordance with an embodiment of the present invention.

The present invention in use serves as an arm control training device. It is an improvement in the art of arm ergometry, with different principles concerning bilateral influences on motor control. The present invention offers a novel and useful exercise intervention for post-stroke hemiparesis where training involves both upper extremities at the same time. Bilateral upper extremity training promotes agonist muscle activity in the hemiparetic arm and facilitates the relearning of sensorimotor relationships during arm function. Consequently, the present invention improves intralimb and interlimb coordination. Thus, training with the present invention may help the neuromuscular system to control the extremities in a more coordinated fashion that not only improves motor performance of the hemiparetic upper extremity but may impact functional outcome as well.

The present invention, a bilateral upper extremity physical exercise training device, is specifically designed for patients who are suffering from hemiparesis or whose motor control is affected due to cerebral palsy, stroke, tumor, head injury, etc. One embodiment of the present invention includes two unyoked handles that travel along straight, or, alternatively, curved tracks at various angles in transverse and frontal planes. In one embodiment, the handles move along the tracks without or with little resistance, such little resistance being accomplished through the use of rollers, wheels, or other devices for minimizing friction or other resistance. Its various modular features and lightweight construction, using materials such as lucite, wood, metals, carbon composites, or other lightweight materials, make it useable by different sized people and with different capabilities, depending on the severity of the stroke. Its various modular features make it useable by people with various levels of control of their upper extremity including shoulder(s), elbow(s), wrist(s), and finger(s). This device is designed to facilitate the remapping and/or the unmasking of dormant neuromuscular pathways. One advantageous utility is for regaining motor control or motor re-learning, rather than strength training. Though not intended as an aerobic exerciser, the present invention is capable of being modified, in some embodiments, to provide aerobic training by adding weights, resistance, yoke, etc., and thus is usable for strength training. The addition of weights, resistance or a yoking device further assists in unmasking neural patterns lost during non-use of the paretic upper extremity.

The present invention is functionally oriented, mimics everyday activities, and can be instrumented to study movement and improvement. Its flexible apparatus, such as yoked versus unyoked, different angles, modified handles, change of arm positions, etc., allows for variable functional movement. It is dimensionally adjustable, scalable for patients of different stature and habitus and is very portable. The present invention fills a void for chronic stroke victims, a previously untreated group, by providing a bilateral upper extremity training device that has the capability to improve their upper extremity function and thereby improve their quality of life.

In some embodiments, the present invention can be elevated to a variety of positions, upward and downward, relative to the user's chest, to provide for a range of movements and therapy. It can be tilted or angled to a variety of positions, upward and downward, relative to the user's chest to provide for a range of movements and therapy. When elevated or angled upward or downward, the chest rest can be adjusted so that the chest rest is positioned correctly relative to the user.

In an alternative embodiment, the apparatus has curved tracks. Curved tracks are useful for certain movements of the shoulder.

In another alternative embodiment, the apparatus has spherical, discus-shaped, square, circular, oval, or other shaped knobs as handles, the shape being conducive for use for bilateral upper extremity training. The knobs can be of various thickness and overall size for comfort for the user. The knobs are attached in manners well known in the art, such that the knobs can turn freely in clockwise and counter-clockwise directions. The knobs can turn without resistance or with resistance. The knobs can be yoked or unyoked. This alternative embodiment permits the user to practice and exercise movements of the wrists and forearms, in supination and pronation movements.

Another alternative embodiment utilizes wrist-handles that are attachable to the user's wrists. This embodiment frees up the fingers so that the user can exercise/move the fingers while moving the arms.

In yet another alternative embodiment of the device, a tracker or counting device is attached to either the handles or the tracks. The tracker or counter maintains count or track of the number of times the user performs the exercise or movement. It is also able to track the time of day. In some embodiments, the tracker or counter stores the information in memory, using devices and methods known in the art, and is able to print out or export the information in a readable format at the convenience of the person supervising the exercise or training. In such a manner, the person supervising the training does not have to be at the user's side each time the device is used.

In another embodiment of the device, an auditory or visual stimulus is added to the device so that the user receives feedback from the usage of the device or obtains goal setting information. An auditory stimulus includes, for example, a metronome or an audio recording. A visual stimulus includes, for example, a visual display component, such as a monitor, screen, television, mirror, or other device containing information on goal setting, performance, or usage of the device.

In another alternative embodiment of the device, resistance is added to the movement of the handles, tracks, or slides.

Alternatively, weights are added to the handles, tracks, or slides. In these embodiments, the device is also used to strengthen the user's muscles. Furthermore, the handles may be yoked when this type of training is deemed advisable.

By changing the elevation, position, and tracks (straight or curved), type of handles, in accordance with these and various embodiments, one can improve the control, functional use of, strength, and active range of motion of the arm(s), hand(s), fingers and/or wrist(s) of the user.

References will now be made in detail to embodiments of the present invention, examples of which are illustrated in the accompanying drawings.

As shown in FIGS. 1-5, the bilateral arm trainer 1 has a base 2 that rests on a flat surface, such as the top surface of a table, desk, counter, or similar furniture. The base 2 is detachably securable to the surface via, for example, clamps, suction cups, screws, nails, or other similar mechanisms. It is preferable to secure the bilateral arm trainer 1 to the surface in order to prevent movement of the entire apparatus during usage. Gravity and friction also act to keep the apparatus 1 on the surface if the apparatus 1 of the embodiment employed is of sufficient weight for such use and, for example, if the surface is not too slippery. Also, a non-skid pad is optionally placeable between the device 1 and the surface to assist in maintaining the device 1 in place. Because the device 1 is preferably light weight for easy transport, in some applications, it is preferable to use clamps or suction cups to secure the apparatus 1 to the surface and to avoid making holes in the surface and the device 1.

In an embodiment of the present invention, an incline plate 3 is securely attached to the base 2 via one or more hinges 4 or similar types of mechanisms. When a hinge 4 is used, the hinge 4 is placed on the edges of the base 2 closest to the user. Thus, the portion of the incline plate 3 furthest from the user is capable of being elevated upward relative to the base 2, thereby generating an angle of inclination $\theta_1$ between the base and the incline plate. This angle of inclination $\theta_1$ is variable between 0° and 90°, most preferably between 0° and 45°.

In accordance with embodiments of the present invention, there are several different mechanisms to keep the angle of inclination $\theta_1$ constant during usage of the invention. In one embodiment, blocks of varying heights are placeable between the base 2 and the incline plate 3 at a pre-determined location. The incline plate 3 rests on the blocks in this embodiment. Depending on the height of the blocks and the location of their placement, one is able to create a known angle of inclination $\theta_1$. A more preferable method is to use a height rod 10, which is attached to the base 2 via a plate or other attachment device 13 at the back of the base 2, furthest from the user. In one embodiment, the height rod 10 has notches in it at pre-determined positions along the length of the height rod 10. A latching bar, which is attached to the incline plate 3, is placeable in the notches on the height rod. Thus, the latching bar is detachably securable to the height rod 10 at a specific location along the height rod 10, thereby to generate a known angle of inclination $\downarrow_1$.

In an alternative embodiment, the height rod 10 has visible markings along its length at predetermined spacings. The height rod 10 transverses a height tube 11, which is attached to the incline plate 3, through an opening in the height tube 11. The height tube 11 also contains a threaded hole into which a screw clamp 12 is threaded. The end of the screw clamp 12 rests against the height rod 10 when the screw clamp 12 is screwed into the threaded hole, thereby securing the position of the height rod 10 in the height tube 11. The screw clamp 12 is unscrewably releaseable, such that the position of the height rod 10 is adjustable within the height tube 11, and then the screw clamp 12 is screwably securable to secure the height rod 10 inside the height tube 11. The angle of inclination $\theta_1$ is thereby adjustable. The visible markings along the height rod 10 allow the angle of inclination $\theta_1$ to be set at known angles. In one embodiment, the height rod 10 is pivotable at the attachment device 13, such as about a pin 14 extending through the attachment device 13.

For both embodiments, the incline plate 3 is shaped such that the incline plate 3 is able to rest flat on the base 2 when the angle of inclination $\theta_1$ is 0° (i.e., the screw thread 12 and the height tube 10 or the latching bar do not interfere with the resting of the incline plate 3 on the base 2).

In an embodiment of the present invention, attached to the front of the base 2 is a user distancing device, such as or including an adjustable chest rest 20. The chest rest 20 keeps the user's chest a pre-determined distance $d_1$ away from the front of the base 2 and stabilizes the user's trunk to isolate arm movement. The distance $d_1$ away from the front of the base 2 and the height h of the chest rest 20 are adjustable to accommodate users with different body sizes and arm lengths. The chest rest 20 has a chest plate 21 that is shapable in one embodiment, but preferably has a flat surface against which the user rests the user's chest. The chest plate 21 is attached to a distance pole 22 via, for example, a ball-and-socket joint 23 to permit free movement of the chest plate 21. The distance pole 22 extends through an opening in the distance pole connector 24, which is attached to the top of a height pole 26. In one embodiment, the distance pole connector 24 also has a threaded hole and a screw clamp 25 that are usable to secure the distance pole 22 into position via pressure of the screw extension against the distance pole 22. The screw clamp 25 is unscrewable, such that the position of the distance pole 22 relative to the hole in the distance pole connector 24 is adjustable to a desired position. The screw clamp 25 is then tightened to secure the distance pole 22 into the desired position. In one embodiment, the distance pole 22 has visible markings on its surface so that the distance pole 22 is capable of being set at a predetermined position.

The height pole 26 is adjustably attached to the base 2 so that the height h of the chest plate 21 may be adjusted. A height pole plate 27 is securely attached to the base 2. The height pole plate 27 contains an opening through which the height pole 26 transverses. The height pole plate 27 also includes a threaded hole into which a screw clamp 28 is screwed. The screw clamp 28 holds the height pole 26 into position via pressure by resting against the height pole 26. The screw clamp 28 is unscreweable, such that the position of the height pole 26 along the hole may be adjusted relative to the height pole plate 27, and the screw clamp 28 is then tightened to secure the height pole 26 into a desired position at height h. In one embodiment, the height pole 26 includes visible markings so that the height pole 26 may be set at a predetermined position.

In an embodiment of the present invention, the incline plate 3 includes one or more recesses 5, such that the height pole plate 27 does not interfere with the adjustment of the incline plate 3 into various positions. Furthermore, the lengths of the height pole 26 and the distance pole 22 are variable such that the height pole 26 and the distance pole 22 do not interfere with the adjustment of the incline plate 3 into various positions. Alternatively, the incline plate 3 has cut-outs to prevent the incline plate 3 from contacting the distance pole 22 or the height pole 26.

In alternative embodiments, different types of clamps are used to secure the distance pole 22 and the height pole 26 into desired positions. Other embodiments provide for use of alternative types of distance spacers and height spacers for maintaining the user at a predetermined distance $d_1$ from the apparatus.

A pair of width plates 30, 31 rest on the incline plate 3 in an embodiment of the present invention. The width plates 30, 31 are secured to the incline plate 3 via one or more screw connectors 32, 33, 34, 35 or other securing mechanisms for each width plate 30, 31. Each width plate 30, 31 has two width slots 36, 37, 38, 39; one screw connector 32, 33, 34, 35 travels through one width slot 36, 37, 38, 39, respectively. In one embodiment, the incline plate 3 has threaded openings positioned beneath the width slots 36, 37, 38, 39. The screw connectors 32, 33, 34, 35 have threads that extend through the width slots 36, 37, 38, 39, respectively, into the corresponding threaded openings in the incline plate 3. The two width slots 32, 33 and 34, 35 for a given width plate 30, 31, respectively, are parallel to each other. Upon loosening of the two screw connectors 32, 33 or 34, 35 for each width plate 30 or 31, that width plate 30 or 31 is slidable to the right or left to the maximum distance allowed by the length of the width slots 32, 33 or 34, 35, as viewed in FIG. 1. Then the two screw connectors 32, 33 or 34, 35 are tightened to secure the width plate 30 or 31 to the incline plate 3. While adjusting the position of a width plate 30 or 31, care must be taken not to remove the screw connector 32, 33, 34, or 35 entirely from the incline plate 3. The sliding movement of the screw connectors 32, 33, 34, 35 within the slots 36, 37, 38, 39, respectively, allows the two width plates 30, 31 to be moved closer together or further apart from each other to the minimum and maximum distances apart allowed by the width slots 36, 37, 38, 39. Thus, the distance between the handles 40, 41 is variable via attachments among the swivel plates 50, 51 and sliding tracks for slidably moving the handles 40, 41. In one embodiment, these sliding tracks, which include movement rods 60, 61, movement blocks 70, 71, friction reduction plates 80, 81, and attachment bars 90, 91, 92, 93, are capable of being adjusted so that the distance from each handle 40, 41 to the chest plate 21 is comfortable for the user. Often the distance between the handles 40, 41 depends on the shoulder width of the user. The width plates 30, 31 are mirror-images of each other.

Figure 4:
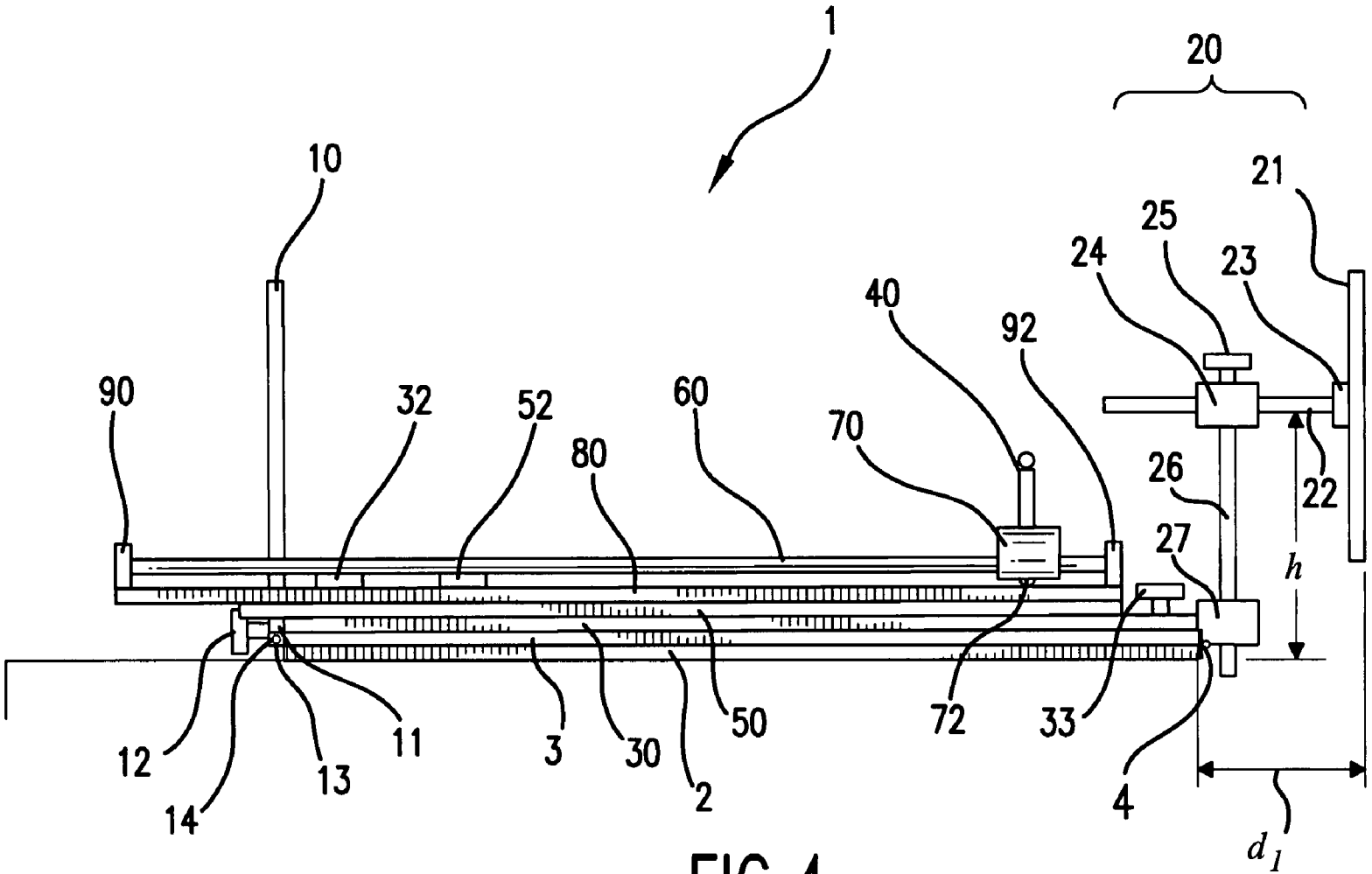
FIG. 4 presents a side view of the bilateral arm trainer of FIG. 1.
Figure 5:
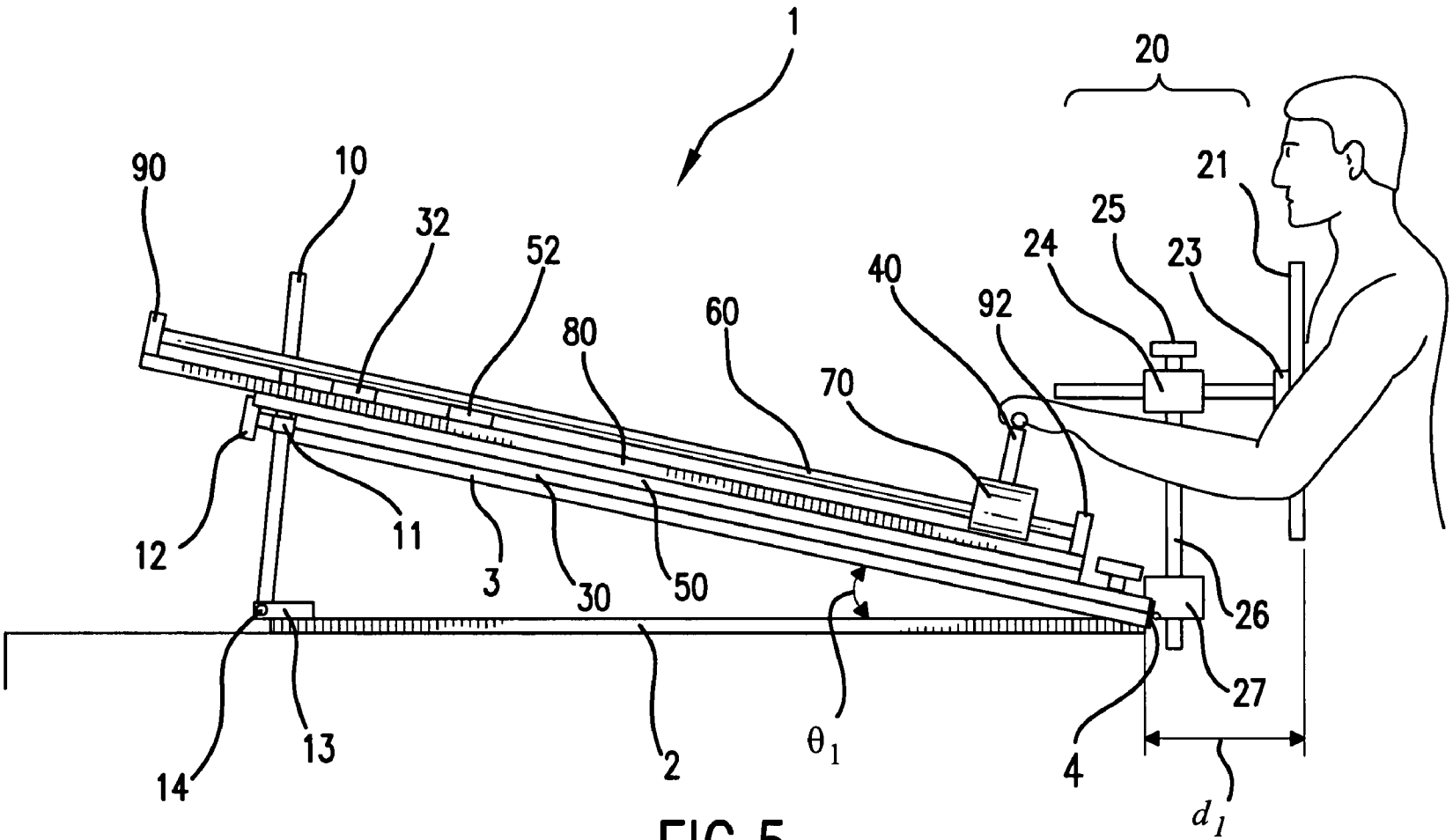
FIG. 5 presents the side view of the bilateral arm trainer of FIG. 1 with the inline plate set inclined by angle $\theta_1$ with the base.

In an embodiment of the present invention, one swivel plate 50, 51 rests on each width plate 30, 31, respectively. The movement rods 60, 61 are securely attached to the swivel plates 50, 51, respectively, via two attachment bars 90, 92 and 91, 93, respectively, and via friction reduction plates 80, 81; one attachment bar 90, 92 and 91, 93 is located at each end of each movement rod 60, 61, respectively. Each movement rod 60, 61 is traversed by a movement block 70, 71, respectively. The movement blocks 70, 71 are movable along the length of the movement rods, 60, 61, respectively. In one embodiment, a linear bearing (e.g., a bearing produced by Walzlager of Germany) is located in the middle of each movement block 70, 71. The movement rods 60, 61 travel through the respective linear bearings. Because of the ball bearings within the linear bearings, each movement block 70, 71 travels with a minimum of friction along each movement rod 60, 61, respectively. In another embodiment, as shown in FIG. 4, each movement block 70 or 71 has a wheel 72 or other friction reducing or stabilizing features for minimizing resistance with respect to friction reduction plates 80, 81 or otherwise enhancing use. Alternatively, a variable friction device or weights are usable so as to provide resistance with respect to movement of movement blocks 70, 71.

Friction reduction plates 80, 81 are attached to the swivel plates 50, 51 beneath the movement rods 60, 61 and beneath the movement blocks 70, 71. In one embodiment, the friction reduction plates 80, 81 have coatings applied that reduce the friction between the plates 80, 81 and the movement blocks 70, 71. One such type of coating is Teflon® made by DuPont E. I. De Nemours & CO of Wilmington, Del.

Movement stops 95, 96 are attached to the movement rods 60, 61. The movement stops 95, 96 are adjustable to any point along the movement rods 60, 61 and securable at any position along the rods 60, 61. The movement stops 95, 96 prevents the movement blocks 70, 71 from being moved beyond the movement stops 95, 96. In one embodiment, each movement stop 95, 96 has a rubber-like coating on the side against which the movement block 70, 71, respectively, touches during usage. Alternatively, a rubber-like washer is placeable around each movement rod 60, 61 in front of the movement stops 95, 96 and in front of the attachment bars 92, 93. One advantage of the rubber-like coating or rubber-like washer is muffling or other reduction in the sound produced when the movement blocks 70, 71 encounter the movement stops 95, 96 and the attachment bars 92, 93.

Similar to the movement stops 95, 96, in an embodiment of the present invention, each of the attachment bars located closest to the user 92, 93, has a rubber-like coating on the side of the attachment bar 92, 93 against which the movement blocks 70, 71 touch during usage. Alternatively, rubber-like washers are placeable around the movement rods 60, 61 between the movement blocks 70, 71 and the attachment bars 92, 93.

In an embodiment of the present invention, a mechanical level arm counter 100 (e.g., an arm counter manufactured by Redington Counters, Inc., of Windsor, Conn.) is attached to the movement stop 95 or 96 on one of the swivel plates 50, 51. The counter 100 records each time the movement block 71 reaches the movement stop 96. The counter 100 is capable of being reset to zero. The user is able to use the counter 100 to keep track of the number of repetitions or other event uses of the device 1.

In one embodiment, one or both of the movement rods 60, 61 include visible markings that allow the setting of the movement stops 95, 96 to predetermined positions. In an alternative embodiment, one or both of the friction reduction plates 80, 81 have visible markings so that the movement stops 95, 96 can be set to predetermined positions. For both embodiments, the visible markings do not interfere with the free flowing movement of the movement blocks 70, 71 along the movement rods 60, 61.

A handle 40, 41 is attached to the top of each movement block 70, 71, respectively. In one embodiment, each handle 40, 41 is T-shaped. In alternative embodiments, the handles 40, 41 are spherical, discus-shaped, square, oval, circular, or any other shape conducive to use for bilateral upper extremity training. Each handle 40, 41 is screwed into a movement block 70, 71 so that the handles 40, 41 may be easily interchanged. The size and shape of each handle 40, 41 is such that the handle 40, 41 fits comfortably in the hand of the user or is comfortable for the user to grasp. A strap is also usable to help hold a user's hand to the handle.

Figure 2:
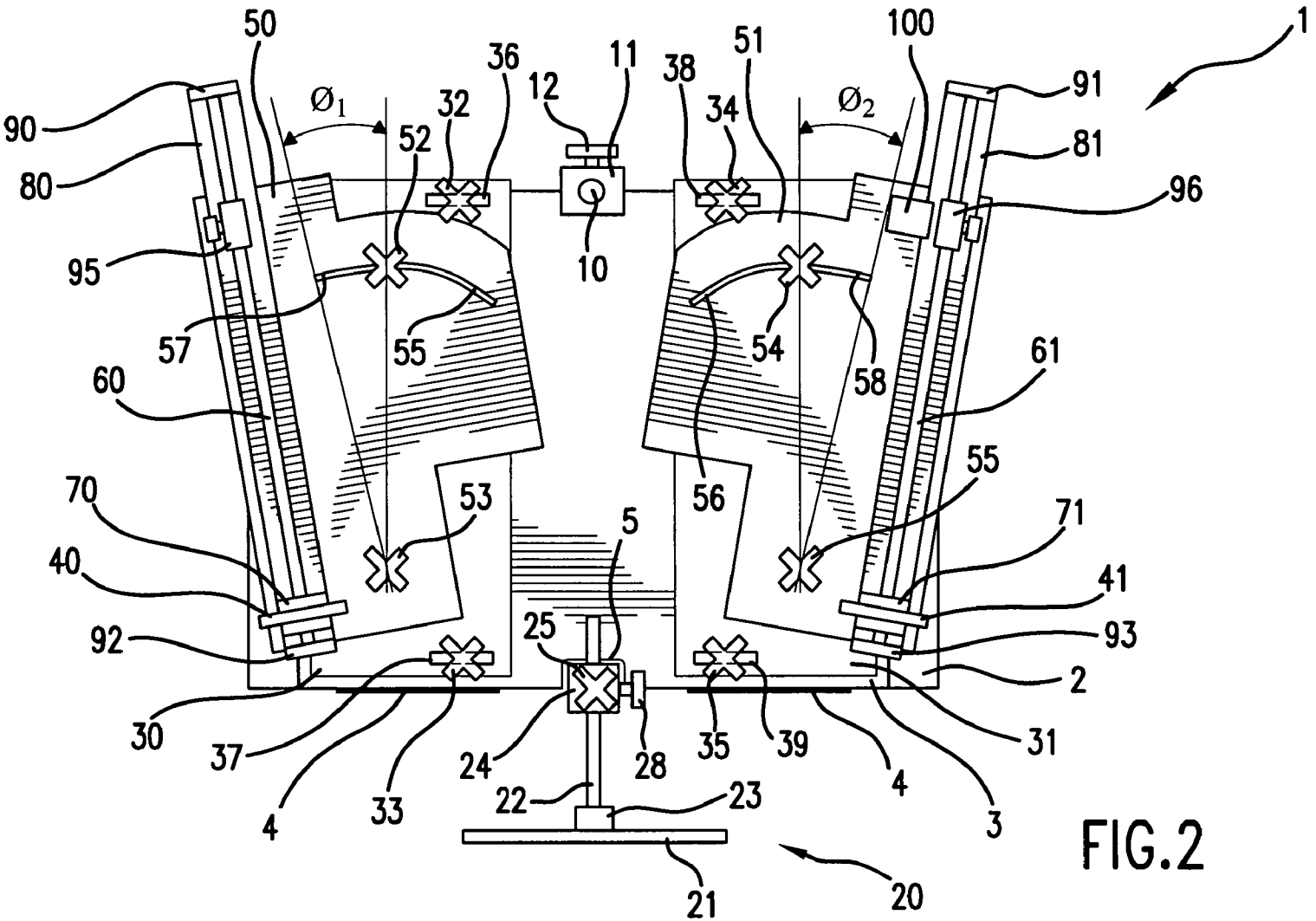
FIG. 2 shows an overhead view of the bilateral arm trainer of FIG. 1 with swivel plates partially swiveled to angles $\phi_2$ and $\phi_1$.
Figure 3:
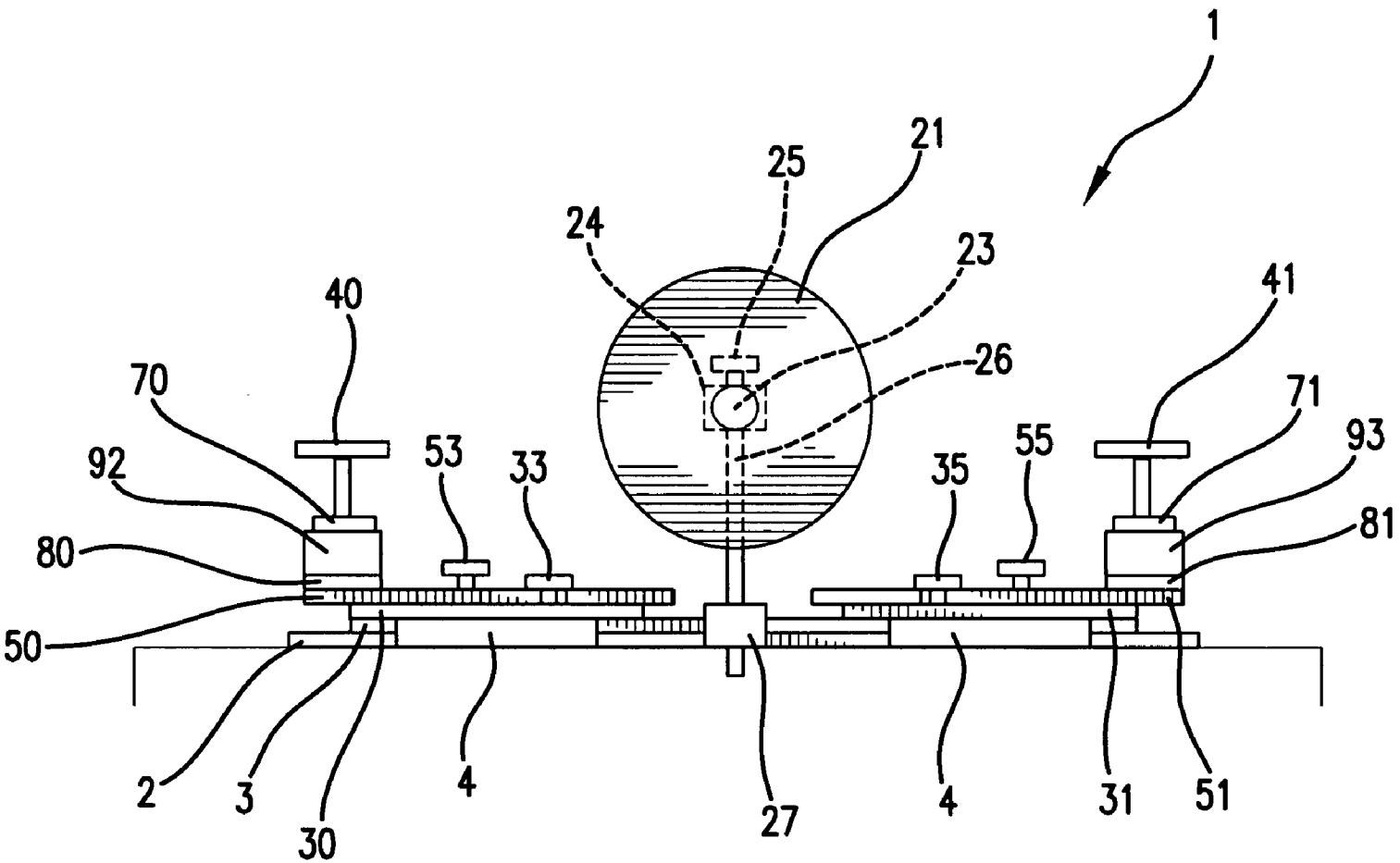
FIG. 3 is an end view of the bilateral arm trainer of FIG. 1.

In one embodiment, each swivel plate 50, 51 is secured to its respective width plate 30, 31 via one or more screw connectors 52, 53, 54, 55. In this embodiment, the pair of screw connectors closest to the user 53, 55 travel through openings in the swivel plates 50, 51 into threaded openings in the width plates 30, 31 directly below the openings in the swivel plates 50, 51. The second pair of screw connectors 52, 54, which are more distant from the user than the first pair screw connectors 53, 55, each pass through a slot 55, 56 in the swivel plates 50, 51 and into threaded openings in the width plates 30, 31 directly below, as best seen in FIG. 1. The slots 55, 56 arc away from the user, such that the portion of each slot 57, 58 that are most distant from the user are also most distant from the mid-point $m_1$ of the apparatus 1. When the slot section screw connectors 52, 54 are loosened for each swivel plate 50, 51, the swivel plates 50, 51 are swivelable in an arc so that the tops of the swivel plates 50, 51, as shown in FIG. 2, swivel outward from the mid-point $m_1$ of the apparatus 1. The swivel angles $\phi_1$ and $\phi_2$ thereby form, $\phi_1$ being between a line connecting the connectors 52, 53 and the end point of the slot 57 in the swivel plate 50, and $\phi_2$ being between a line connecting the connectors 54, 55 and the end point of the slot 58 in the swivel plate 51. The angles $\phi_1$ and $\phi_2$ are variable in the range of about 0° to 90°, most preferably 0° to 45°.

Figure 6:
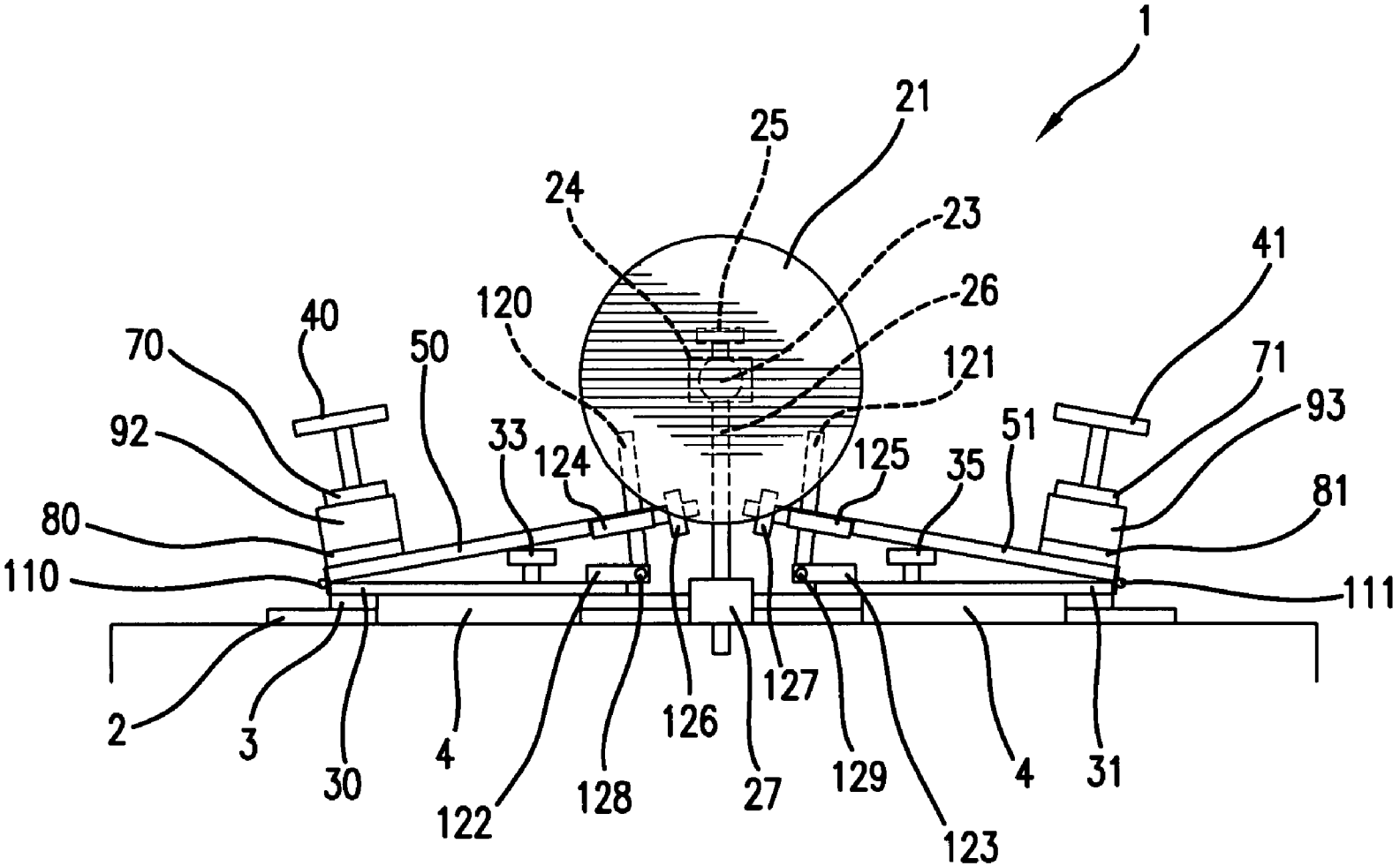
FIG. 6 is an end view of a bilateral arm trainer in accordance with an embodiment of the present invention in which the swivel plates are pivotable.

FIG. 6 presents a variation of the embodiment shown in FIGS. 1-5. As shown in FIG. 6, each swivel plate 50, 51 is hinged to the width plate 30, 31 below each swivel plate 50, 51, along the outer edge of the swivel plate 50, 51 and the width plate 30, 31. This hinge permits each swivel plate 50, 51 to be pivoted upward relative to the width plates 30, 31 on pivoting devices 110, 111, such as hinges attaching swivel plates 50, 51 to width plates 30, 31, respectively. The angles between the swivel plates 50, 51 and the width plates 30, 31 are called the swivel angles. The swivel angles range from about 0° to 90°. A number of holding devices are usable in accordance with this embodiment to maintain the pivoted swivel plates 50, 51 in angled positions. For example, in the embodiment shown in FIG. 6, height rods 120, 121 attached to width plates 30, 31 by attachment devices 122, 123 extend through height tubes 124, 125 attached to swivel plates 50, 51. Screw clamps 126, 127, for example, are used in conjunction with the height tubes 124, 125 to hold the swivel plates 50, 51 at selected angles relative to the width plates 30, 31. In one embodiment, the height rods 120, 121 are pivotable at the attachment devices 122, 123, such as about pins 128, 129 extending through the attachment devices 122, 123.

In an embodiment of the present invention, a carrying strap is securely attached to the base 2 at one side of the base so that it does not interfere with the movement of the rest of the apparatus 1. The carrying strap is used to move the device.

When a patient uses the bilateral arm trainer, the patient is seated comfortably at, for example, a table in front of the device 1 with the following limb positions: ankles in neutral dorsiflexion, knees and hips placed at 90°, shoulders in 0° flexion, elbows in 60° flexion, and wrists in neutral position of flexion/extension. The width plates 30, 31 are adjusted so that the user is able to comfortably hold the handles 40, 41. In most circumstances, the width plates 30, 31 are adjusted so that the movement blocks 70, 71 are approximately aligned with the user's shoulders, the alignment being along the lengthwise axis of the movement rods 60, 61.

In operation, the patient grasps the handles 40, 41, or the affected hand is strapped to the handle 40, 41, depending on the severity of the deficits. By using shoulder flexion/protraction and elbow extension the handles 40, 41 are pushed away from the patient, and then (using shoulder extension/retraction and elbow flexion) pulled towards the patient's body. This action mimics the behavior of the patient reaching and bringing an object to the patient. When necessary an assistant provides minimal assistance for the affected arm, such as to help with the arm extension. On some occasions, the assistance is particularly useful for the purpose of keeping the elbow from impacting the table. The movement stops 95, 96 are adjusted so that the movement blocks 70, 71 are unable to travel further than the user can reach and to provide sensorimotor feedback and a goal for the patient.

In a nonrandomized pilot study performed using a device in accordance with an embodiment of the present invention, and particularly in accordance with the embodiments shown in FIGS. 1-5, the effects of six weeks (18 therapist hours) arm training on 14 patients with chronic hemiparetic stroke both immediately after training and after a retention period were investigated. The study produced surprisingly successful results.

Bilateral arm training for four 5-minute bouts per session was performed using the device of the present invention with no weights or other resistance to arm motion. The following measurements were taken: The Fugl-Meyer Upper Extremity Motor Performance Test which measures impairments; the Wolf Motor Function Test which measures timed functional ability and the University of Maryland Arm Questionnaire for Stroke (UMAQs), which measures daily use. Isometric strength and range of motion (ROM) measures were also taken.

Figure 8:
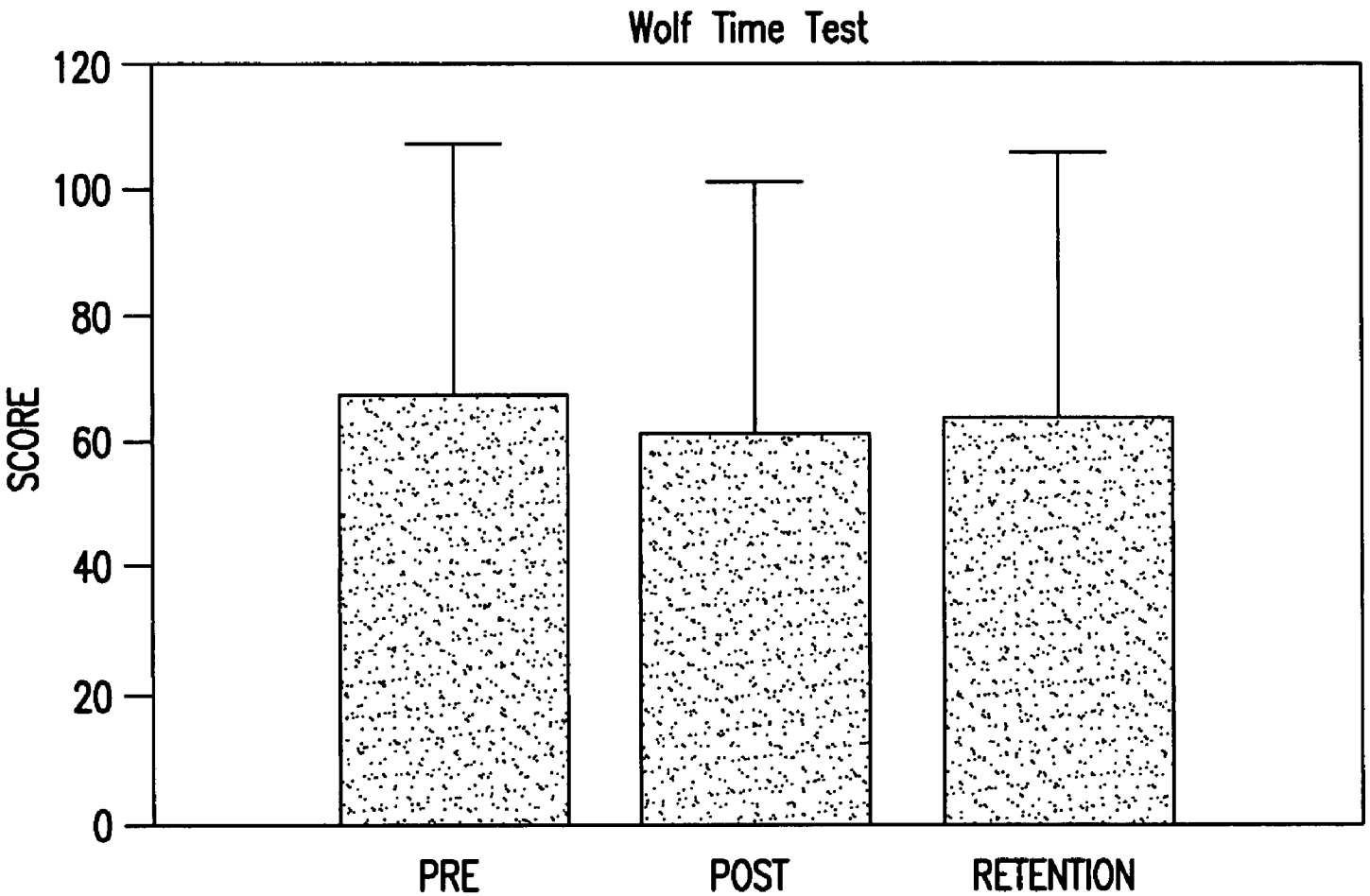
FIG. 8 presents the Wolf Function score of 11 patients for a study performed using a device in accordance with an embodiment of the present invention.
Figure 9:
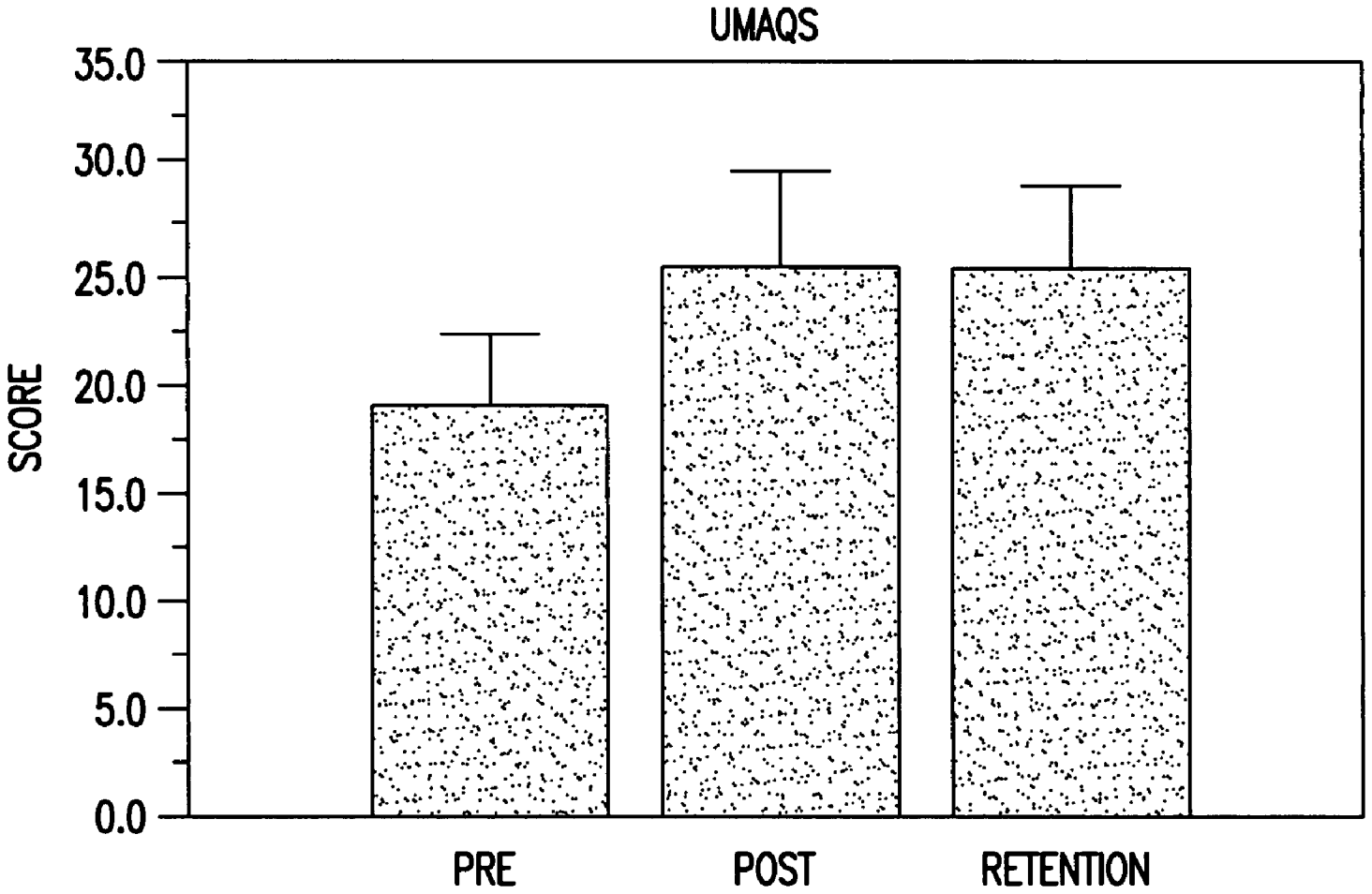
FIG. 9 shows the UMAQS score of 11 patients for a study performed using a device in accordance with an embodiment of the present invention.

Patients showed significant and durable increases in the Fugl-Meyer ($p<0.0004$) (see FIG. 7), the Wolf time test ($p<0.02$) (See FIG. 8) and the UMAQS ($p<0.002$) (See FIG. 9). Isometric strength was improved only in shoulder extension for the affected limb and elbow flexion/grip strength in the less affected limb. Active ROM for thumb opposition (affected) and passive ROM for shoulder extension (unaffected) were also significantly improved.

Six weeks of bilateral arm training improved both impairments and functional use of the paretic limb with very few concomitant changes in isometric strength and ROM. These results were surprising compared to the prior art, given that the following additional details relating to the study were used. In the study, researchers employed the well-known principles of forced-use and task-specificity, but did not employ the commonly used concept of constraining the non-paretic arm. Specifically, the use of bilateral, repetitive rhythmic reaching and retrieving actions was forced using a metronome to cue the patients.

Auditory cueing has been used successfully to promote immediate and post training gait changes over and above those produced by gait training alone in sub-acute stroke patients. Indeed, bilateral arm training, including such training provided in conjunction with rhythmic auditory cueing, has more in common with current gait (leg) rather than arm training paradigms, except for at least one important feature: gait training paradigms typically have some element of physical conditioning that may produce exercise-mediated cardiovascular or musculoskeletal adaptations that could contribute to improved functional mobility and endurance. In contrast, the embodiment of the present invention used in the study is designed to reduce, although it cannot completely eliminate, conditioning in order to better isolate the effects of motor training as an independent variable.

This initial single group design study examined the efficacy and potential durability of a novel training protocol in patients with chronic stroke. The researchers hypothesized that the present invention would result in significant improvements in sensorimotor impairments, functional ability, and daily use of the paretic arm. Based on the nature of the training, they hypothesized, also, that few significant changes would be found in strength or range of motion outcome measures.

Details of the study are as follows. A total of 14 patients completed the study, including eight males and six females with chronic hemiparetic arm dysfunction. At the time of recruitment all patients had long been discharged from conventional post-stroke rehabilitation and were at least 12 months, and a median of 30 months, post stroke. Baseline evaluations included a medical history, the Folstein Mini-Mental Status Exam, and the Orpington Prognostic Scale.

Inclusion criteria were: at least six months since a unilateral stroke, ability to follow simple instructions and two step commands, volitional control of the non-paretic arm, and at least minimal antigravity movement in the shoulder of the paretic arm. Exclusion criteria were: symptomatic cardiac failure or unstable angina, uncontrolled hypertension (<190/110), significant orthopedic or chronic pain conditions, major post-stroke depression, active neoplastic disease, severe obstructive pulmonary disease, dementia (MMSE<22); aphasia with inability to follow two step commands or severe elbow or finger contractures that would preclude passive ROM of the arm.

Training consisted of 20 minutes of use of the present invention three times per week for six weeks (18 sessions). In each session, patients were seated comfortably at a table in front of a custom-designed bilateral arm trainer, in accordance with the embodiments of FIGS. 1-5 of the present invention, in the following limb positions: ankles in neutral dorsiflexion, knees and hips placed at 901, shoulders in 01 flexion, elbows in 601 flexion, and wrists in neutral position of flexion/extension. The apparatus (see FIGS. 1-5) consisted of two independent T-bar handles that could move, nearly friction-free (without added weights or other resistance), in the transverse plane (perpendicular to the patient). The patient grasped the handles, or the affected hand was strapped to the handle, depending on the severity of the deficits. By using shoulder flexion/protraction and elbow extension the handles were pushed away and then (using shoulder extension/retraction and elbow flexion) pulled towards the body. This action mimics the behavior of reaching and bringing an object to self. When necessary, the trainer provided minimal assistance for the affected arm, sometimes to help with the arm extension and other times particularly for the purpose of keeping the elbow from impacting the table. In these cases, patients were encouraged to provide the active pushing and pulling. The handles of the apparatus were positioned at shoulder width for each patient, and a padded chest guard was adjusted to rest against the patient. The chest guard was used to prevent the patient from utilizing their trunk while reaching forward. Recently, at least one study has confirmed that patients with chronic hemiplegia have a significant tendency to use trunk flexion in order to reach, compared to non-hemiplegic controls.

The training itself consisted of the following parameters: four, five-minute duration periods of use of the present invention, interspersed with 10-minute rest periods. By having the rest periods twice as long as the exercise periods, conditioning effects were hypothesized to be reduced. Heart rate and blood pressure measurements were taken before and after each five-minute training period to check for adverse cardiovascular reaction and assess for aerobic conditioning. Four active training periods enabled the session to be completed in one hour—a typical treatment time for outpatient-based occupational therapy (TO). Periods consisted of bilateral repetitive pushing/pulling movements that were simultaneous (in-phase) for periods 1 & 3 and alternating (antiphase) for periods 2 & 4. Movements were timed to an auditory metronome set at the participant's preferred speed that was established at the first session by asking patients to assume a comfortable speed that they could continue for five minutes. This frequency remained constant across the entire six weeks of training, with no increase in workload, again in an attempt to reduce specific conditioning effects.

There was an eight weeks post-cessation of training period to assess retention. During this time patients were asked to do no special training, but to continue to use their paretic arm on activities that they had identified on the daily use scale (see below).

Figure 7:
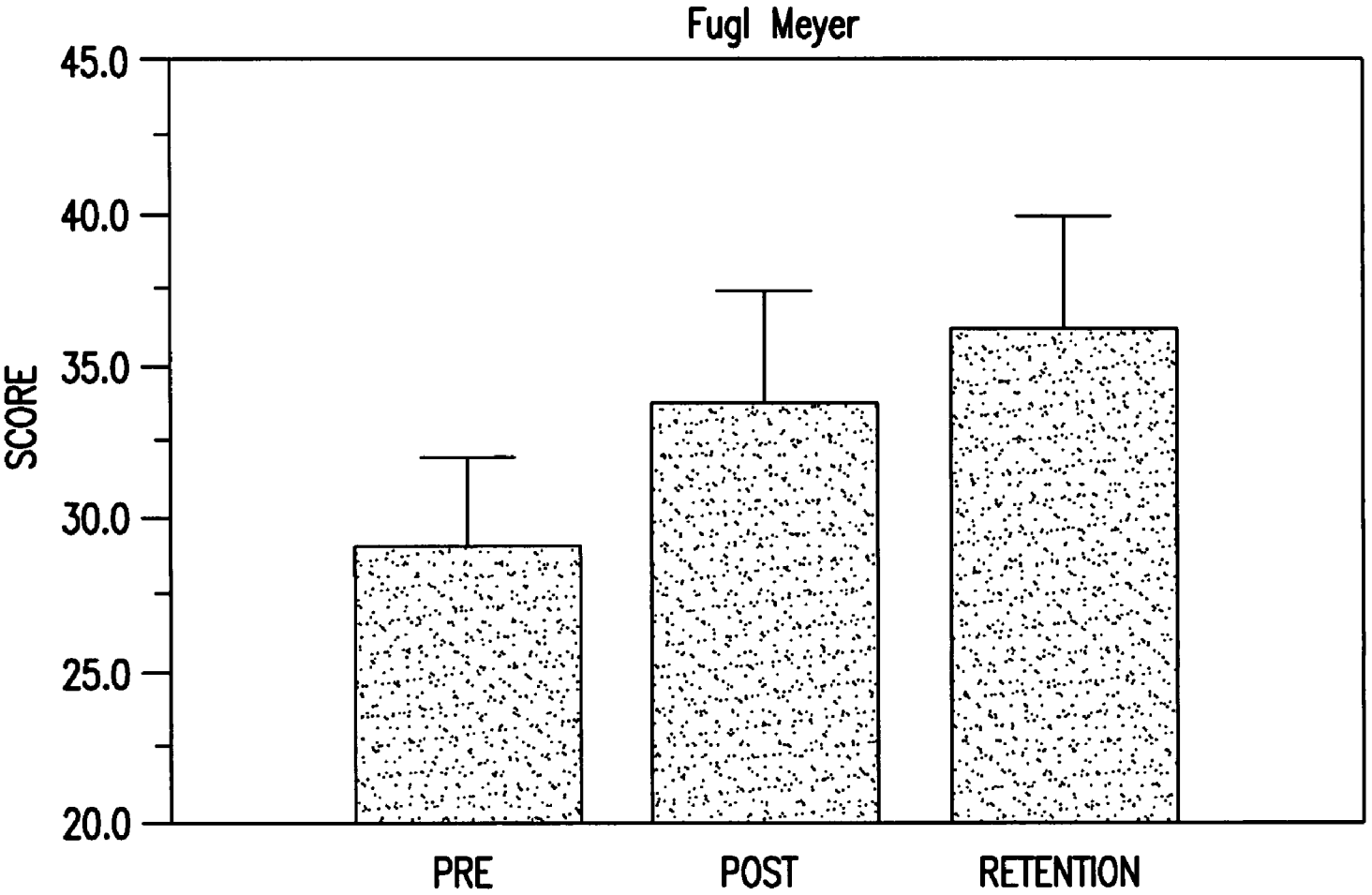
FIG. 7 shows the Fugl Meyer score of 14 patients for a study performed using a device in accordance with an embodiment of the present invention.

A pre-test, post-test, and retention-test consisted of the following items. (1) the Fugl-Meyer Upper Extremity Motor Performance Section Test, selected because it assesses impairments in sensorimotor function. This test has been shown to be valid and reliable, and it correlates well with interjoint UE coordination measures in the upper extremity of patients post stroke. It has a top score of 66. FIG. 7 shows the Fugl Meyer score of the 14 patients. (2) The Wolf Motor Function Test, selected because it reliably measures functional ability in a variety of activities and appears to be more sensitive than other upper extremity tools. On this test, timed items assess speed of performance. The ability to lift a weight assesses functional strength and quality of motor function is assessed using a five-step ordinal scale. FIG. 8 presents the Wolf Function score for 11 patients. (3) A custom-designed questionnaire, the University of Maryland Arm Questionnaire for Stroke (UMAQS), has been developed to assess daily use of the paretic arm in accomplishing activities of daily living (ADL's) based on a five-point ordinal scale that grades degree of independence. The top score is 50. This questionnaire differs from the Functional Independence Measure by measuring daily use rather than level of assistance and from the Motor Activity Log because it accounts for unilateral and bilateral tasks, as well as considering handedness. FIG. 9 shows the UMAQS score of 11 patients. Types of activities include typical ADL's, as well as lifting, carrying, and pulling a two-handled drawer. Activities that are hand specific and complementary (e.g., eating with a fork in the dominant hand and supporting a plate with the non-dominant hand) are on separate, but equivalent, questionnaires that are administered according to whether the affected hand was dominant or non-dominant pre-stroke. The researchers also graded patient satisfaction and perceived improvement based on five-point scales to provide patient self-report of the effectiveness of using the present invention. The UMAQS is currently being tested for reliability and validity, including caregiver confirmation regarding the accuracy of the responses. (4) Isometric strength of the shoulder (flexion/extension/abduction), elbow (flexion/extension), wrist (flexion/extension) and thumb opposition was measured using the Chatillon Force Dynamometer, manufactured by Chatillon of New York and grip strength using the BASELINE Hydraulic Hand Dynamometer, manufactured by BASELINE of New York. (5) Active ROM/Passive ROM (AROMIPROM) of the upper extremities was determined using standard goniometry, which has been demonstrated to be reliable and sensitive (within 51).

The initial analyses were a one-way repeated measures ANOVAS to compare the pre-, post- (six weeks training) and retention (eight weeks post-cessation of training) test measures on the dependent variables. Significant results were further investigated with post hoc (Tukey HSD) comparisons. Subjects 1-3 did not undergo retention testing or the Wolf and UMAQS tests since these were added to the protocol later. Therefore, non-significant results were duplicated with a one-way repeated measures analysis to compare pre-post on all 14 subjects. Alpha level was set at 0.05.

The characteristics of the subject pool completing the study are shown in Table 1. All but one subject (#7) had more than trace movement at the shoulder, but only three subjects could extend the finger joints by at least 101 or the wrist joint by at least 201. The group mean increase in training heart rate summed across sessions 1, 6, 12 and 18 was unchanged at 2.7 beats (+/−3.1). Notwithstanding the fact that some patients were on medications that would influence these results, there was no indication of an aerobic training adaptation.

TABLE 1

Characteristics of Subject Population

| Subject | Age | Gender | Months since CVA | Side of CVA | Hand Dom. | Orpington Category | MMSE |
|---|---|---|---|---|---|---|---|
| 1 | 62 | Female | 26 | Left | Right | Mod | 15* |
| 2 | 60 | Male | 29 | Right | Right | Min | 28 |
| 3 | 44 | Female | 30 | Right | Right | Mod | 23 |
| 4 | 60 | Male | 40 | Right | Left | Min | 26 |
| 5 | 89 | Male | 192 | Left | Right | Min | 27 |
| 6 | 68 | Male | 204($1^{st}$) 39($2^{nd}$) | Left | Left | Mod | 21 |
| 7 | 80 | Female | 18 | Right | Right | Severe | 30 |
| 8 | 70 | Male | 59 | Right | Right | Min | 28 |
| 9 | 67 | Male | 360 | Right | Right | Mod | 26 |
| 10 | 49 | Female | 29 | Left | Right | Mod | 29 |
| 11 | 62 | Female | 31 | Left | Left | Min | 30 |
| 12 | 44 | Female | 23 | Left | Right | Min | 28 |
| 13 | 65 | Male | 46 | Right | Right | Mod | 30 |
| 14 | 73 | Male | 14 | Left | Right | Min | 22 |

*Secondary to expressive aphasia but subject could follow 2 step commands

The Fugl-Meyer Upper Extremity Motor Performance Section Test scores showed significant improvements ($p<0.004$). Post-hoc analysis revealed that both the post- and retention-test scores were higher than the pre-test score (reflecting an 18% and 26% increase, respectively, and effect sizes of 0.41 and 0.66) (See FIG. 7). The Wolf Motor Function Test scores for performance time showed significant improvements over the three testing periods ($p<0.02$). Post hoc analysis revealed that both the post- and retention-test scores were significantly higher than the pre-test score (reflecting a 12% and 13% increase, respectively, and effect sizes of 0.20 and 0.20) (See FIG. 8). Neither the weight nor the quality of function aspects of the Wolf test revealed significant differences, although both showed a trend for improvement. The UMAQS questionnaire section on daily use showed significant improvements over the three testing periods ($p<0.002$). Post hoc analysis revealed again that post- and retention-test scores were significantly higher than the pre-test score (reflecting a 42% and 43% increase, respectively, and effect sizes of 0.52 and 0.55) (See FIG. 9). The relatively small sample size precludes drawing any conclusions concerning the effect of pre-morbid handedness and side of CVA.

The patient satisfaction section of the UMAQS revealed that all but one subject (#7) reported that they were either satisfied or very satisfied with the training. Similarly, all but subject #7 reported that they had improved a little or a lot after training. These ratings were maintained at the retention period. Subject #7 was the only subject who made no improvement throughout the training. She was also the only one with a severe categorization from the Orpington Prognostic Scale and barely trace movement. Patients also reported the following: "I can use my arm more"; "I can feel my arm more"; "I can hold onto things now"; "I can do things with two hands"; and "I feel like I have two arms again".

Four out of 16 strength measures revealed significant improvements. For the paretic arm, elbow flexion ($p<0.05$ but no post hoc differences) and wrist flexion (pre vs. post = $p<0.02$) were significant. For the non-paretic arm, elbow flexion ($p<0.02$; pre vs. retention) and wrist extension ($p<0.02$; pre vs. retention) were significant. Four out of 28 AROM and PROM measures revealed significant improvements. For the paretic arm, AROM for shoulder extension ($p<0.01$; pre vs. post), wrist flexion ($p<0.004$; pre vs. post) and thumb opposition ($p<0.002$; pre vs. post/pre vs. retention) were significant. For the paretic arm, also, PROM for wrist flexion (pre vs. post=0.03) was significant. Table 2 displays the mean values of these significant changes in strength and ROM.

TABLE 2

Significant Changes in Mean Strength and Range of Motion Measures

| Measure | Pretest (n = 14) | Post-test (n = 14) | Pretest (n = 11) | Post-test (n = 11) | Retention Test (n = 11) |
|---|---|---|---|---|---|
| Strength* | | | | | |
| Paretic arm | | | | | |
| Wrist flexion | 4.58 | 6.35 | | | |
| Elbow flexion | | | 7.93 | 9.28 | 9.77 |
| Non-paretic arm | | | | | |
| Wrist extension | | | 9.40 | 10.45 | 11.84 |
| Elbow flexion | | | 12.95 | 14.17 | 16.55 |
| ROM† | | | | | |
| Paretic arm | | | | | |
| Active | | | | | |
| Shoulder extension | | | 39.55 | 48.45 | 44.10 |
| Wrist flexion | | | 23.27 | 36.36 | 27.91 |
| Thumb opposition‡ | | | .91 | 1.36 | 1.45 |
| Paretic arm | | | | | |
| Passive | | | | | |
| Wrist flexion | 71.21 | 75.57 | | | |

*Strength measured in Kg force
†ROM measured in degrees
‡Three point ordinal scale In this single group design study, the researcher found six weeks of use of the present invention improved several key measures of sensorimotor impairments, functional ability (performance time), and functional use in patients with chronic UE hemiparesis. Furthermore, these improvements were maintained at two months after patients stopped training, suggesting the motor improvements were potentially durable. This supports the hypothesis that forced-use in a repetitive stereotypic training program, in this case bilaterally, improves motor function in chronic hemiparetic stroke patients that have long since completed conventional training.

A rationale as to why active bilateral UE training with the present invention is successful includes the following. Practicing bilateral movements in synchrony (and in alternation) may result in a facilitation effect from the non-paretic arm to the paretic arm. For example, when initiating bimanual movements simultaneously, the arms act as a unit that supercedes individual arm action, indicating that both arms are strongly linked as a coordinative unit in the brain. It is well known that even if one arm or hand is activated with a moderate force, this can produce motor overflow in the other such that both arms are engaged in the same or opposite muscle contractions although at different levels of force. Furthermore, studies have shown that learning a novel motor skill with one arm will result in a bilateral transfer of skill, subsequently, to the other arm. Taken together with the knowledge gained with use of the present invention, a strong neurophysiological linkage in the CNS is suggested.

An aspect of the present invention, as used in this study, is the rhythmic repetition of an action via auditory cueing. Repetition, or "time on task" is a well-known motor learning principle, and recent animal studies have demonstrated that "forced use" involving a repetitive motor task rather than forced-use alone may best promote central neural plasticity. Rhythmic auditory cueing has three advantages. First, by holding frequency constant, it ensures that the same movement is actually repeated. In effect, the auditory cueing may entrain the motor system to its beat. Second, trying to match the sound with full extension or flexion provides an attentional goal for the patient. Goal setting is also known to promote motor learning. One recent study demonstrated the efficacy of having a real object (goal) to reach for in patients with hemiparetic arms. Third, receiving feedback has been shown to be fundamental to motor learning. In this experiment, sensory information from the audio cues, as well as that from visual and somatosensory sources, provided intrinsic feedback to the patient regarding the movement goal. Collectively, it is plausible that the techniques employed involving repetition and cueing, based as they are on motor learning principles in non-hemiparetic persons, may also contribute to motor re-learning in the hemiparetic case.

The researchers' initial findings suggest that even patients with quite severe UE hemiparesis can benefit from a program using the present invention, in contrast to what is suggested in some of the prior art. Constraint-induced (CI) protocols require subjects to have a fair degree of voluntary movement. For example, in some prior studies, patients have been excluded if they could not achieve at least 10° of active extension at the metacarpophalangeal and interphalangeal joints of the hand and 20° of active extension at the wrist of the affected limb. Other prior studies have required subjects to actively initiate wrist and finger extension on the hemiparetic side. Similar criteria applied to pre-test AROM measures for the study in accordance with the present invention would have excluded 11 of the 14 subjects. Though it is not yet established whether the CI paradigm may be beneficial to patients that are not highly functioning, the results of this study suggest that a protocol using the present invention improves motor function in patients with much denser UE hemiparesis. This expands the applicability of forced-use, task-oriented training across a broader deficit severity spectrum in chronic stroke.

Also in contrast to the suggestions of the prior art, the training protocol of the present study demonstrates that gains can be attained over a relatively brief training period. The time spent training the arms, six hours, is about one tenth of the intervention time used in the CI paradigm, although the treatment time period of the latter is shorter (two weeks vs. six weeks). Conceivably, the distributed practice in the present study (72 periods of five minutes) vs. the massed nature of the CI paradigm (10 periods of 360 minutes) contributed to the former's success over a shorter exercise time. Regardless, the present study demonstrates the surprising result that functional gains in a chronic paretic arm can be achieved after only six hours total training, leaving the possibility that longer training periods, or other variations of use of the present invention, including progressive or incremental resistive components, could result in greater motor and functional gains.

Prior studies have argued that changes that occur quickly after practice represent either an "unmasking" of dormant neuromuscular pathways or cortical reorganization and sensorimotor learning of new neural pathways. Re-conditioning of the neuromuscular system by reversing disuse atrophy may contribute to functional gain. Although no direct measures of conditioning were taken with the study using one embodiment of the present invention, physiological changes at the level of skeletal muscle, such as hypertrophy, and change in fiber type are not expected within this time frame and at such low intensity training. Indeed, the researchers for this study, using one embodiment of the present invention, observed few changes in strength measures after training or at retention testing. For example, in the paretic arm, wrist flexion improved after training, but was not retained. Evidently the action of pulling the handle towards the body produced this temporary gain. Temporary gains were also seen in the AROM of shoulder extension and wrist flexion of the paretic arm. Only AROM for paretic thumb opposition was a retained gain. In the non-paretic arm, elbow flexion and wrist extension were strengthened, but not significantly so until after the training had finished (making these data hard to interpret). Overall, the few, largely temporary, strength and ROM changes are not supportive of large muscular conditioning effects, as expected given the training protocol.

In a subsequent single case study, structural and brain activation images obtained from a 62 year old patient two years after suffering a complete right MCA ischemic stroke demonstrated activation of new foci in primary and premotor cortices in both hemispheres induced by six weeks of training using the present invention. This supports the idea that bilateral arm training does result in central neural changes, rather than peripheral muscle changes.

In conclusion, this study suggests that a regimen using the present invention, based on motor learning principles, leads to significant and potentially durable functional gains in the paretic UE of chronic hemiparetic patients. The present invention is appropriate for patients with greater baseline severity motor deficits than are amenable to CI treatments of the prior art. Moreover, the intervention is not prohibitively complex, and hence may be feasible for home-use by many patients.

Example embodiments of the present invention have now been described in accordance with the above advantages. It will be appreciated that these examples are merely illustrative of the invention. Many variations and modifications will be apparent to those skilled in the art.

What is claimed is:

1. A device for bilateral upper extremity training, comprising:

a base;

a pair of sliding tracks attached to the base;

a pair of handles slidably movable along the sliding tracks; and a pair of swivel plates connected to the base;

wherein the handles are unyoked and have minimal resistance for movement along the tracks, wherein the pair of sliding tracks are attached to the base via the pair of swivel plates.

2. The device of claim 1, further comprising: a chest rest connected to the base.

3. The device of claim 1, further comprising:

a pair of swivel plates connected to the base;

wherein the pair of sliding tracks are attached to the base via the pair of swivel plates.

4. The device of claim 1, wherein the pair of sliding tracks are separated by a sliding tracks separation distance, and wherein the sliding tracks separation distance is variable.

5. The device of claim 4, further comprising:

a pair of width plates, each of the width plates being separated by a width plate separation distance, the width plate separation distance being variable;

wherein the pair of sliding tracks is attached to the base via the pair of width plate, and wherein the sliding tracks separation distance varies as a function of variation of the width plate separation distance.

6. A device for bilateral upper extremity training comprising:

a base;

a pair of width plates, each of the width plates being separated by a width plate separation distance, the width plate separation distance being variable;

a pair of sliding tracks attached to the base via the pair of width plates;

a pair of handles slidably movable along the sliding tracks; and an incline plate attached to the base;

wherein the handles are unyoked and have minimal resistance for movement along the tracks, wherein the pair of sliding tracks are separated by a sliding tracks separation distance, wherein the sliding tracks separation distance is variable as a function of variation of the width plate separation distance, and wherein the pair of width plates is attached to the base via the incline plate.

7. The device of claim 6, wherein the pair of width plates is attached to the incline plate via at least a pair of connecting devices.

8. The device of claim 1, wherein the pair of sliding tracks is inclinable relative to the base.

9. The device of claim 8, wherein the pair of sliding tracks is attached to the base via a pivoting device, and wherein the pair of sliding tracks is inclinable relative to the base via the pivoting device.

10. The device of claim 6, wherein the pair of sliding tracks is inclinable relative to the base.

11. The device of claim 10, wherein the pair of sliding tracks is inclinable relative to the base via the incline plate.

12. The device of claim 1, wherein the pair of handles is slidably movable along the sliding tracks via a pair of friction reduction devices.

13. The device of claim 12, wherein the pair of friction reduction devices comprises bearings.

14. The device of claim 12, wherein the pair of friction reduction devices comprises wheels.

15. The device of claim 2, wherein the chest rest is positionable such that a chest of user of the device rests against the chest rest when a user grips the handles.

16. A method of restoring a degree of neurologic function for at least one upper extremity of a human individual who has lost some degree of neurologic function for the extremity subsequent to stroke, by employing the device of claim 1, the method comprising:

having the user repetitively move at least one from a group consisting of the first handle and the second handle along at least one from a group consisting of the first track and the second track for a period of time sufficient to restore a degree of neurologic function for the extremity.

17. A method for cortical remodeling and sensorimotor relearning for a person suffering from neurological damage caused by one from a group consisting of stroke, tumor, injury, and cerebral palsy, the neurological damage resulting in diminished movement of at least one upper body extremity, the method comprising:

moving by the person pair of unyoked handles along a pair of sliding tracks;

wherein the sliding tracks are attached to a base via a pair of swivel plates connected to the base, wherein the handles move with a minimum of resistance along the sliding tracks for a period of time, and wherein the moving of the pair of unyoked handles unmasks neural pathways.

18. The method of claim 17, wherein moving the pair of unyoked handles occurs in rhythm with an audible cue.

19. The method of claim 17, wherein at least one of the pair of handles is moved by an upper body extremity.

20. The method of claim 19, wherein the upper body extremity has neurological damage.

21. A device for bilateral upper extremity training, comprising:

a base;

a pair of sliding tracks attached to the base;

a pair of handles slidably movable along the sliding tracks; and a chest rest connected to the base;

wherein the handles are unyoked and have minimal resistance for movement along the tracks, wherein the chest rest is positionable such that a chest of a user of the device rests against the chest rest when a user grips the handles, and wherein a plane in which the chest rest is oriented is transverse to a direction in which the handles are slidably movable along the sliding tracks.

* * * * *

UNITED STATES PATENT AND TRADEMARK OFFICE

CERTIFICATE OF CORRECTION

PATENT NO. : 7,850,579 B2
APPLICATION NO. : 11/353033
DATED : December 14, 2010
INVENTOR(S) : Jill Whitall, Sandy McCombe-Waller and David Grant It is certified that error appears in the above-identified patent and that said Letters Patent is hereby corrected as shown below:

Column 4, Line 1 --one=s-- should be changed to "one's".

Column 4, Line 28 --personal-- should be changed to "personnel".

Column 5, Line 14 --invention=s"-- should be changed to "invention's".

Column 7, Line 13 --inline-- should be changed to "incline".

Column 9, Line 9 --fingers-- should be changed to "finger(s)".

Column 9, Line 56 --$\downarrow_1$-- should be changed to "$\theta_1$".

Column 10, Line 16 --$d_1$-- should be changed to "$d_1$".

Column 10, Line 18 --$d_1$-- should be changed to "$d_1$".

Column 10, Line 19 --h-- should be changed to "$h$".

Column 10, Line 41 --h-- should be changed to "$h$".

Column 10, Line 52 --h-- should be changed to "$h$".

Column 11, Line 2 --$d_1$-- should be changed to "$d_1$".

Column 13, Line 2 --$m_1$-- should be changed to "$m_1$".

Column 13, Line 6 --$m_1$-- should be changed to "$m_1$".

Column 14, Line 6 --5-minute-- should be changed to "five-minute".

Column 16, Line 47 --(AROMIPROM)-- should be changed to "(AROM/PROM)".

Signed and Sealed this
Seventh Day of February, 2012

David J. Kappos

David J. Kappos
*Director of the United States Patent and Trademark Office*